US009343029B2

(12) United States Patent
Hung et al.

(10) Patent No.: US 9,343,029 B2
(45) Date of Patent: May 17, 2016

(54) GATE DRIVING CIRCUIT AND RELATED LCD DEVICE CAPABLE OF SEPARATING TIME FOR EACH CHANNEL TO TURN ON THIN FILM TRANSISTOR

(75) Inventors: Ching-Ho Hung, Hsinchu (TW); Chao-Chih Hsiao, Taipei (TW); Yen-Po Chen, Hsinchu (TW); Bor-Chun Wu, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 795 days.

(21) Appl. No.: 12/828,301

(22) Filed: Jul. 1, 2010

(65) Prior Publication Data

US 2011/0102416 A1 May 5, 2011

(30) Foreign Application Priority Data

Nov. 5, 2009 (TW) ..... 98137574 A

(51) Int. Cl.
*G09G 3/36* (2006.01)

(52) U.S. Cl.
CPC ..... *G09G 3/3677* (2013.01)

(58) Field of Classification Search
CPC ..... G09G 3/3677
USPC ..... 345/100
See application file for complete search history.

(56) References Cited

U.S. PATENT DOCUMENTS 5,432,529 A * 7/1995 Azuhata ..... 345/100
5,563,624 A * 10/1996 Imamura ..... 345/100
6,396,468 B2 * 5/2002 Matsushima et al. ..... 345/87
6,407,729 B1 * 6/2002 Moon ..... 345/99
6,961,034 B2 11/2005 Kusanagi
7,464,275 B2 * 12/2008 Lim ..... G06F 1/26 345/211
7,948,467 B2 * 5/2011 Chang et al. ..... 345/100
2001/0013852 A1 * 8/2001 Matsushima et al. ..... 345/92
2002/0093500 A1 * 7/2002 Kashiwada ..... 345/204
2002/0154110 A1 * 10/2002 Anzai et al. ..... 345/211
2004/0189566 A1 * 9/2004 Nakamura et al. ..... 345/87
2005/0179630 A1 * 8/2005 Huang ..... G09G 3/3648 345/87
2006/0012552 A1 * 1/2006 Chiu et al. ..... 345/87
2006/0244710 A1 * 11/2006 Iriguchi et al. ..... 345/100
2006/0284820 A1 * 12/2006 Hong et al. ..... 345/100
2007/0164969 A1 * 7/2007 Kim ..... 345/99
2008/0049000 A1 * 2/2008 Kim et al. ..... 345/204
2008/0062072 A1 * 3/2008 Yang et al. ..... 345/55

(Continued)

FOREIGN PATENT DOCUMENTS

TW 562964 11/2003
TW 200530980 9/2005

(Continued)

*Primary Examiner* — Claire X Pappas
*Assistant Examiner* — Robert Stone
(74) *Attorney, Agent, or Firm* — Winston Hsu; Scott Margo

(57) ABSTRACT

A gate driving circuit for an LCD device includes a shift register module for generating a plurality of scan signals corresponding to a plurality of channels according to a start signal and a clock signal, a plurality of logic circuits each corresponding to a channel of the plurality of channels, for outputting a driving signal to the channel according to a scan signal of the plurality of scan signals and a shutdown indication signal, and a plurality of shaping and delay units each coupled between two neighboring channels for outputting the shutdown indication signal to another channel after shaping and delaying the shutdown indication signal of a previous stage.

4 Claims, 9 Drawing Sheets

(56) References Cited

U.S. PATENT DOCUMENTS

| | | | | |
|---|---|---|---|---|
| 2008/0100558 | A1* | 5/2008 | Yu | 345/100 |
| 2008/0122824 | A1 | 5/2008 | Lee | |
| 2008/0129903 | A1 | 6/2008 | Hong | |
| 2008/0158204 | A1* | 7/2008 | Chang et al. | 345/204 |
| 2008/0238852 | A1* | 10/2008 | Tsai | 345/98 |
| 2008/0266220 | A1* | 10/2008 | Wang et al. | 345/87 |
| 2009/0276668 | A1* | 11/2009 | Hung | 714/726 |
| 2009/0315868 | A1* | 12/2009 | Yokoyama et al. | 345/204 |

FOREIGN PATENT DOCUMENTS

| | | |
|---|---|---|
| TW | 200608341 | 3/2006 |
| TW | 200828233 | 7/2008 |
| TW | 200839707 | 10/2008 |

* cited by examiner

GATE DRIVING CIRCUIT AND RELATED LCD DEVICE CAPABLE OF SEPARATING TIME FOR EACH CHANNEL TO TURN ON THIN FILM TRANSISTOR

BACKGROUND OF THE INVENTION

1. Field of the Invention

The present invention relates to a gate driving circuit and related liquid crystal display (LCD) device, and more particularly, to a gate driving circuit and related LCD device capable of separating time for each channel to turn on a thin film transistor (TFT), in order to facilitate dispersing current when the LCD device is turned off.

2. Description of the Prior Art

A liquid crystal display (LCD) device has merits such as light weight, low power consumption, and low radiation, and therefore has been widely used in information products, e.g. a computer system, a mobile phone, a personal digital assistant (PDA). Operating principles of the LCD device are that different orientation of liquid crystal molecules has different polarization and refraction effects to light beams. Thus, light transmittance of the LCD device can be controlled by altering the orientation of the liquid crystal molecules, so as to generate light with different intensity, and red, blue and green lights with different gray levels.

Please refer to FIG. 1, which is a schematic diagram of a conventional thin film transistor (TFT) LCD device 10. The LCD device 10 includes an LCD panel 100, a timing control circuit 102, a source driving circuit 104, a gate driving circuit 106 and a common voltage generator 108. The LCD panel 100 includes two substrates, and liquid crystal molecules are filled between these two substrates. One substrate is disposed with a plurality of data lines 110, a plurality of scan lines (gate lines) 112 perpendicular to the data lines 110, and a plurality of TFTs 114, while the other substrate is disposed with a common electrode for providing a common voltage Vcom via the common voltage generator 108. For the sake of simplicity, only four TFTs 114 are shown in FIG. 1, but in practical, there is one TFT 114 at every intersection of each data line 110 and scan line 112, i.e. the TFTs 114 are disposed on the LCD panel 100 in matrix. Each data line 110 is corresponding to a column of the LCD device 10, each scan line 112 is corresponding to a row of the LCD device 10, and each TFT 114 is corresponding to a pixel. Besides, the circuit characteristics of the two substrates of the LCD panel 100 can be seen as an equivalent capacitor 116.

In the LCD device 10, the timing control circuit 102 generates and outputs control signals to the source driving circuit 104 and the gate driving circuit 106 respectively, and thus, the source driving circuit 104 and the gate driving circuit 106 generate input signals for different data lines 110 and scan lines 112, so as to control conduction of the TFTs 114 and voltage difference of the equivalent capacitor 116, and further alter the orientation of the liquid crystal molecules and the corresponding light transmittance, to show image data 122 on the LCD panel 100. For example, the gate driving circuit 106 inputs a pulse into the scan lines 112, to conduct the TFTs 114. Therefore, signals inputted into the data lines 110 by the source driving circuit 104 can be inputted into the equivalent capacitor 116 via the TFTs 114, so as to control the gray level status of the corresponding pixel. In addition, different gray levels can be generate by controlling magnitude of signals inputted into the data lines 110 via the source driving circuit 104.

Since circuit characteristics of the liquid crystal is similar to a capacitor, the equivalent capacitor 116 stores charges with different coulombs during operations of the LCD device 10. If the charges stored in the equivalent capacitor 116 are not effectively released when the LCD device 10 is tuned off, the LCD panel 100 generates phenomena of residual images, blinking, etc, affecting image quality when the LCD device 10 is turned on again. Therefore, in order to solve the above problems, the conventional LCD device 10 needs a mechanism for releasing residual charges when the LCD device 10 is turned off, which is detailed as follows.

Signals outputted from the timing control circuit 102 to the gate driving circuit 106 include a shutdown indication signal XON, which is utilized for indicating an operation state of the LCD device 10. For example, when the shutdown indication signal XON is at a high level, the LCD device 10 is in an ON state, and when the shutdown indication signal XON is at a low level, the LCD device 10 is in an OFF state. Therefore, when the LCD device 10 is turned on and not yet turned off, the shutdown indication signal XON is still at the high level. When the LCD device 10 is turned off by a user or a system control, the level of the shutdown indication signal XON shifts to the low level immediately. When the level of the shutdown indication signal XON shifts from the high level to the low level, the gate driving circuit 106 outputs a high voltage level voltage VGH to each channel (i.e. the scan line 112), to turn on all the TFTs 114, such that the residual charges of the equivalent capacitor 116 can be released, so to avoid phenomena of residual images, blinking, etc. when the LCD device 10 is turned on again.

When all channels output the high voltage level voltage VGH, which can be seen as all channels simultaneously drain currents from a power supply, a voltage drop occurs when the currents pass conductive wires, such that operating timing of the gate driving circuit 106 is affected, leading to abnormal display. In order to avoid the above problems, a proper delay is generated in the transmission path of the shutdown indication signal XON in the prior art, to separate time for each channel to output the high voltage level voltage VGH, for dispersing current supply. Generally, methods for generating a delay utilize resistors/capacitors (RC) circuits, i.e. a transmission path of the shutdown indication signal XON between neighboring channels is set by an RC circuit, for delaying the shutdown indication signal XON. However, RC circuits have high variations and cannot generate a uniform time constant, causing too less or too much delay, which affects charge releasing operation and even results in abnormal display.

SUMMARY OF THE INVENTION

Therefore, an objective of the present invention is to provide a gate driving circuit and related LCD device.

The present invention discloses a gate driving circuit for a liquid crystal display (LCD) device. The LCD device includes a plurality of channels. The gate driving circuit includes a shift register module, for generating a plurality of scan signals corresponding to the plurality of channels according to a start signal and a clock signal, a plurality of logic circuits, each corresponding to a channel of the plurality of channels, for outputting a driving signal to the channel according to a scan signal of the plurality of scan signals and a shutdown indication signal, and a plurality of shaping and delay units, each coupled between two neighboring channels, for outputting the shutdown indication signal to another channel after shaping and delaying the shutdown indication signal of a previous stage.

The present invention further discloses an LCD device, including a panel, including a plurality of channels, a timing control circuit, for generating a start signal, a clock signal and an shutdown indication signal, a source driving circuit, coupled between the timing control circuit and the panel, for outputting image data to the panel, and a gate driving circuit, coupled between the timing control circuit and the panel, for driving the panel to display the image data. The gate driving circuit includes a shift register module, for generating a plurality of scan signals corresponding to the plurality of channels according to the start signal and the clock signal, each corresponding to a channel of the plurality of channels, for outputting a driving signal to the channel according to a scan signal of the plurality of scan signals and a shutdown indication signal, and a plurality of shaping and delay units, each coupled between two logic circuits of the plurality of logic circuits corresponding to two neighboring channels, for outputting the shutdown indication signal after shaping and delaying the shutdown indication signal of a previous stage.

The present invention further discloses a gate driving circuit for a liquid crystal display (LCD) device. The LCD device includes a plurality of channels. The gate driving circuit includes a shift register module, for generating a plurality of scan signals to the plurality of channels according to a first multiplex result and a second multiplex result, a first multiplexer, for selecting to output a start signal or a high level signal according to an shutdown indication signal, to generate the first multiplex result, and a second multiplexer, for selecting to output a display clock signal or a charge release clock signal according to the shutdown indication signal, to generate the second multiplex result.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
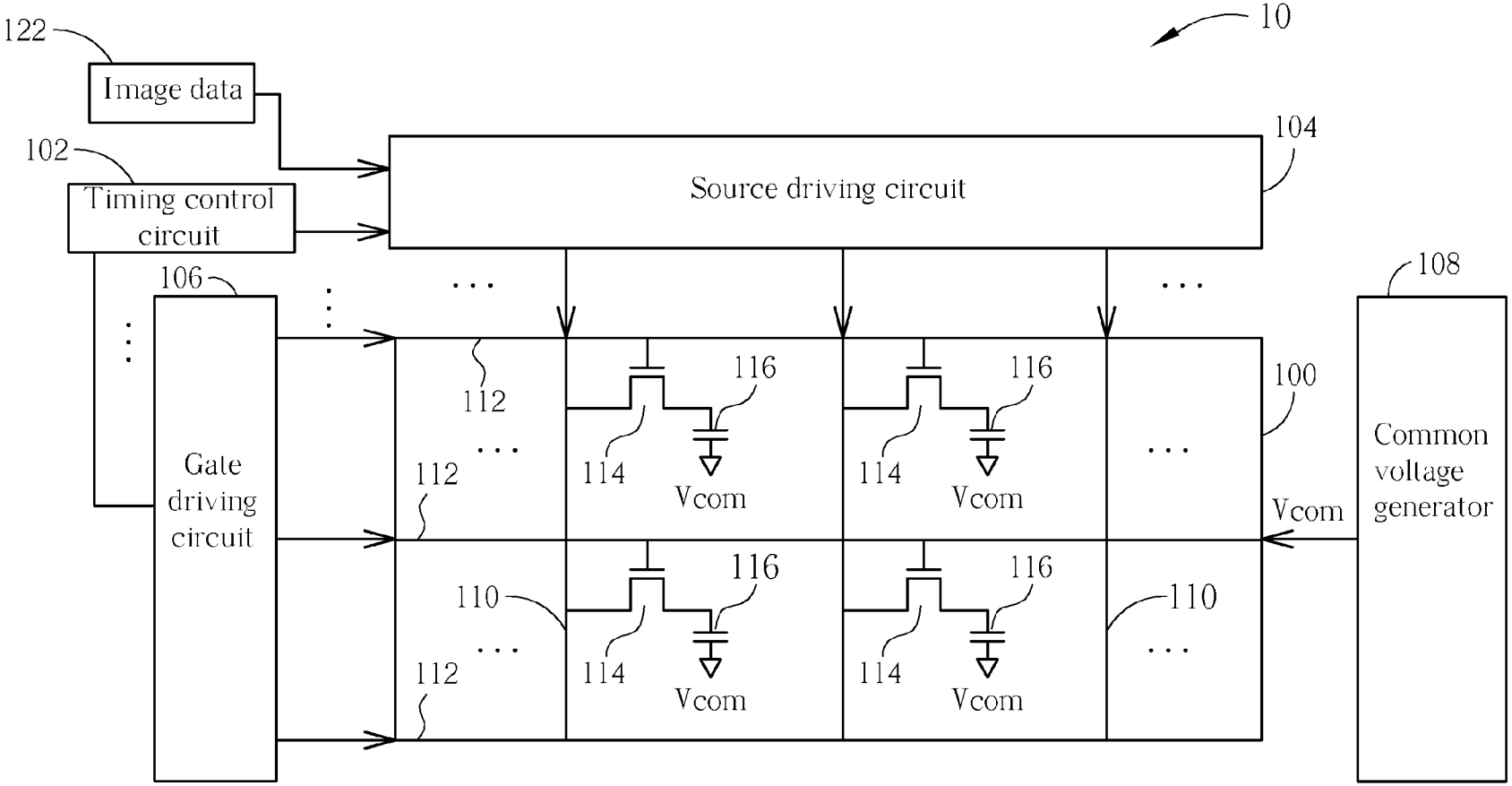
FIG. 1 PRIOR ART
FIG. 1 is a schematic diagram of a conventional TFT LCD device.
Figure 2A:
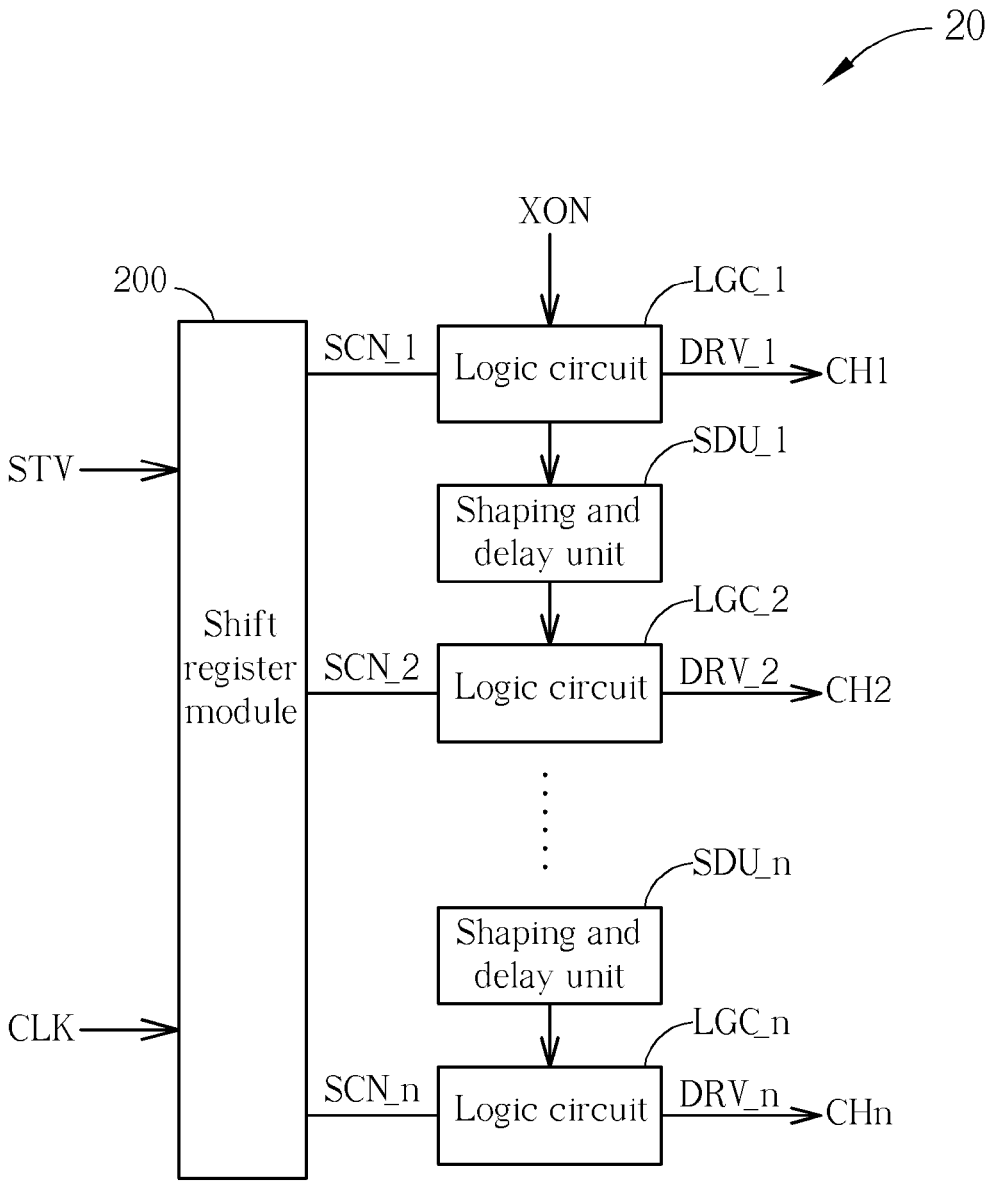
FIG. 2A is a schematic diagram of a gate driving circuit according to an embodiment of the present invention.

Please refer to FIG. 2A, which is a schematic diagram of a gate driving circuit 20 according to an embodiment of the present invention. The gate driving circuit 20 is utilized for replacing the gate driving circuit 106 shown in FIG. 1, to avoid the great current generated by charge releasing when the LCD device 10 is turned off. For clearly illustrating the concept of the present invention, the scan lines 112 on the LCD panel 100 as shown in FIG. 1 are called channels CH1-CHn. The gate driving circuit 20 includes a shift register module 200, logic circuits LGC_1-LGC_n and shaping and delay units SDU_1-SDU_(n−1). The shift register module 200 is utilized for generating scan signals SCN_1-SCN_n corresponding to channels CH1-CHn according to a start signal STV and a clock signal CLK generated by the timing control circuit 102. The logic circuits LGC_1-LGC_n outputs driving signals DRV_1-DRV_n to the channels CH1-CHn according to the scan signals SCN_1-SCN_n outputted by the shift register module 200 and the shutdown indication signal XON generated by the timing control circuit 102. Meanwhile, each logic circuit outputs the received shutdown indication signal XON to the corresponding shaping and delay unit. Each shaping and delay unit SDU_1-SDU_(n−1) is coupled between two neighboring logic circuits, for outputting the shutdown indication signal XON to next logic circuit after shaping and delaying the shutdown indication signal XON for a predefined period.

In detail, when the LCD device 10 is turned off, the level of the shutdown indication signal XON changes instantaneously, e.g. from high to low. Thus, the logic circuit LGC_1 outputs the driving signal DRV_1 of the high voltage level voltage VGH to the channel CH1 according to the shutdown indication signal XON and the scan signal SCN_1, and transmits the shutdown indication signal XON to the shaping and delay unit SDU_1 in the meantime. After the shaping and delay unit SDU_1 properly shapes and delays the shutdown indication signal XON transmitted by the logic circuit LGC_1 for a predefined period, the shutdown indication signal XON is transmitted to the logic circuit LGC_2, such that the logic circuit LGC_2 can output the driving signal DRV_2 of the high voltage level voltage VGH to the channel CH2, and transmits the shutdown indication signal XON to the shaping and delay units SDU_2. By the same token, the logic circuits LGC_1-LGC_n sequentially output the driving signals DRV_1-DRV_n of the high voltage level voltage VGH to the channels CH1-CHn with the same delay period, which can separate time for the channels CH1-CHn to turn on corresponding TFTs 114 and further disperse currents, to avoid the voltage drop generated when currents passes conductive wires, for maintaining the following operations normally.

Figure 2B:
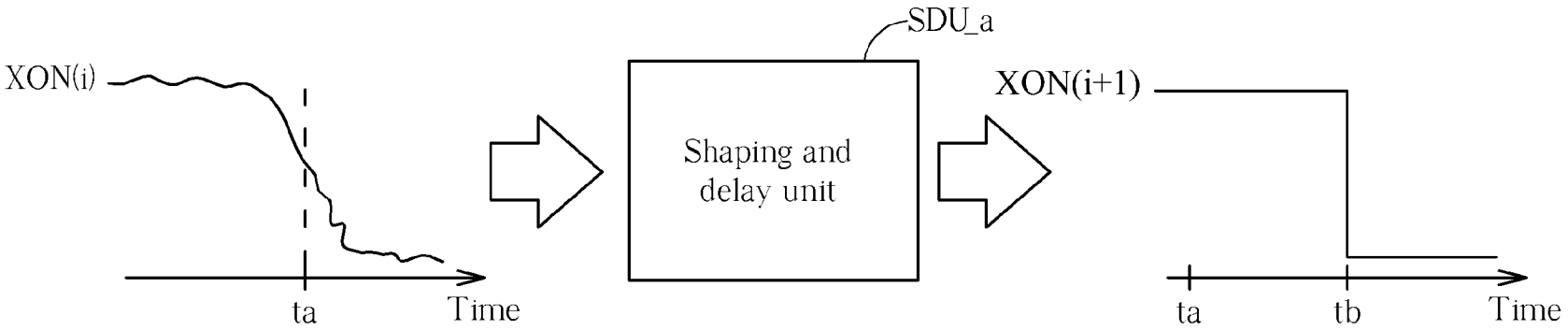
FIG. 2B is a schematic diagram of input and output signals of a shaping and delay unit shown in FIG. 2A.

Therefore, by use of the shaping and delay units SDU_1-SDU_(n−1), when the LCD device 10 is turned off, the logic circuits LGC_1-LGC_n sequentially output the driving signals DRV_1-DRV_n of the high voltage level voltage VGH to the channels CH1-CHn with the same delay period, such that time for the channels CH1-CHn to turn on the corresponding TFTs 114 is separated, to avoid the voltage drop generated when currents pass conductive wires. Noticeably, the shaping and delay units SDU_1-SDU_(n−1) delay the shutdown indication signal XON for the predefined period, and properly shape the shutdown indication signal XON. For example, assume that the waveform of the shutdown indication signal XON received by a shaping and delay unit SDU_a is affected by noise or component defect as shown in the left side of FIG. 2B. After processing of the shaping and delay units SDU_a, a waveform as shown in the right part of FIG. 2B can be generated. As can be seen by comparing waveforms in the right and left sides of FIG. 2B, the shaping and delay unit SDU_a delays the shutdown indication signal of a previous stage XON(i) for a total period of (tb−ta), and filters the interference in the waveform. In such a situation, the shaping and delay units SDU_1-SDU_(n−1) can ensure that the processed shutdown indication signal XON(i+1) is outputted to the logic circuits LGC_2-LGC_n after being delayed for the predefined period.

Figure 2C:
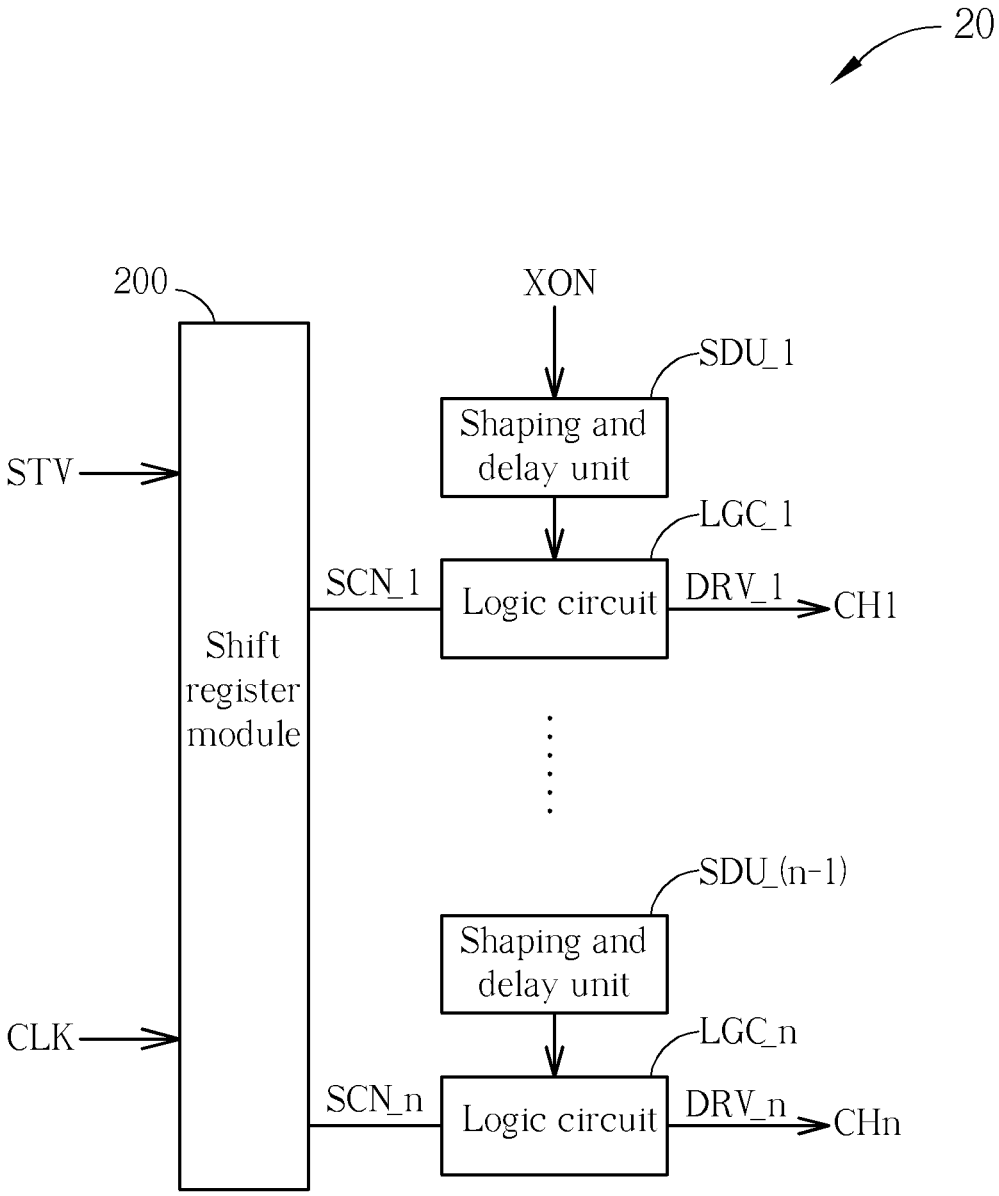
FIG. 2C is a schematic diagram of the gate driving circuit shown in FIG. 2A according to another embodiment of the present invention.

In FIG. 2A, the shaping and delay units SDU_1-SDU_(n−1) are utilized for outputting the shutdown indication signal XON to the next logic circuit after shaping and delaying the shutdown indication signal XON for a predefined period. Noticeably, realization or location of the shaping and delay units SDU_1-SDU_(n−1) is not limited to a specific type, as long as the above objective can be achieved. For example, locations of each logic circuit and the corresponding shaping and delay unit can be exchanged, i.e. the shutdown indication signal XON is outputted to the logic circuit after the shutdown indication signal XON processed by the shaping and delay unit first, as shown in FIG. 2C. In such a situation, the number of shaping and delay units and the number of logic circuits are the same, i.e. n.

Figure 3A:
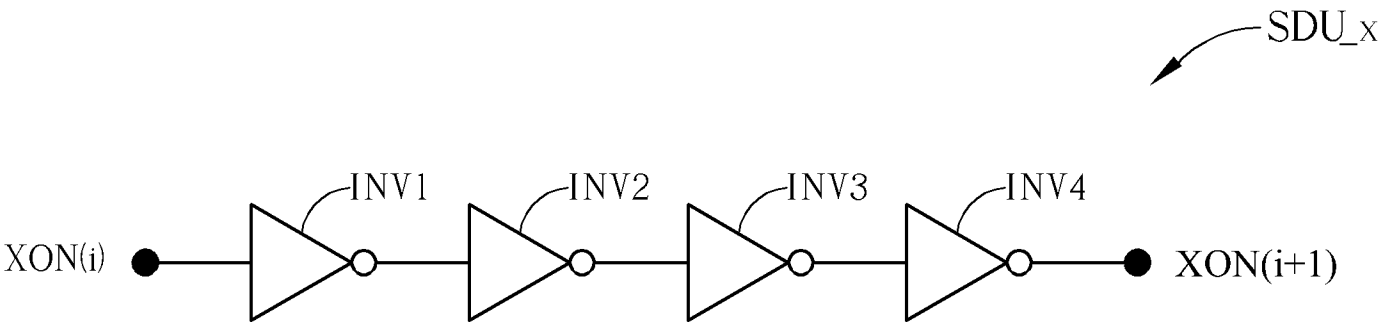
FIG. 3A is a schematic diagram of a shaping and delay unit according to an embodiment of the present invention.

Furthermore, please refer to FIG. 3A, which is a schematic diagram of a shaping and delay unit SDU_x according to an embodiment of the present invention. The shaping and delay unit SDU_x includes inverters INV1-INV4. Each inverter can output input signals after inverting and delaying the input signals for a predefined period. Therefore, after passed through the four inverters INV1-INV4, the shutdown indication signal XON (i+1) outputted by the shaping and delay unit SDU_x is delayed 4 times delay period of the inverters, and has the same phase. The advantage of utilizing inverters to realize a shaping and delay unit is that delaying and shaping can be achieved at the same time after signals is passed through the inverters. Certainly, whether the phase of the shutdown indication signal XON(i+1) outputted by the shaping and delay unit SDU_x is inverted retains the spirit of the present invention. The embodiment is illustrated in signals with the same phase.

Figure 3B:
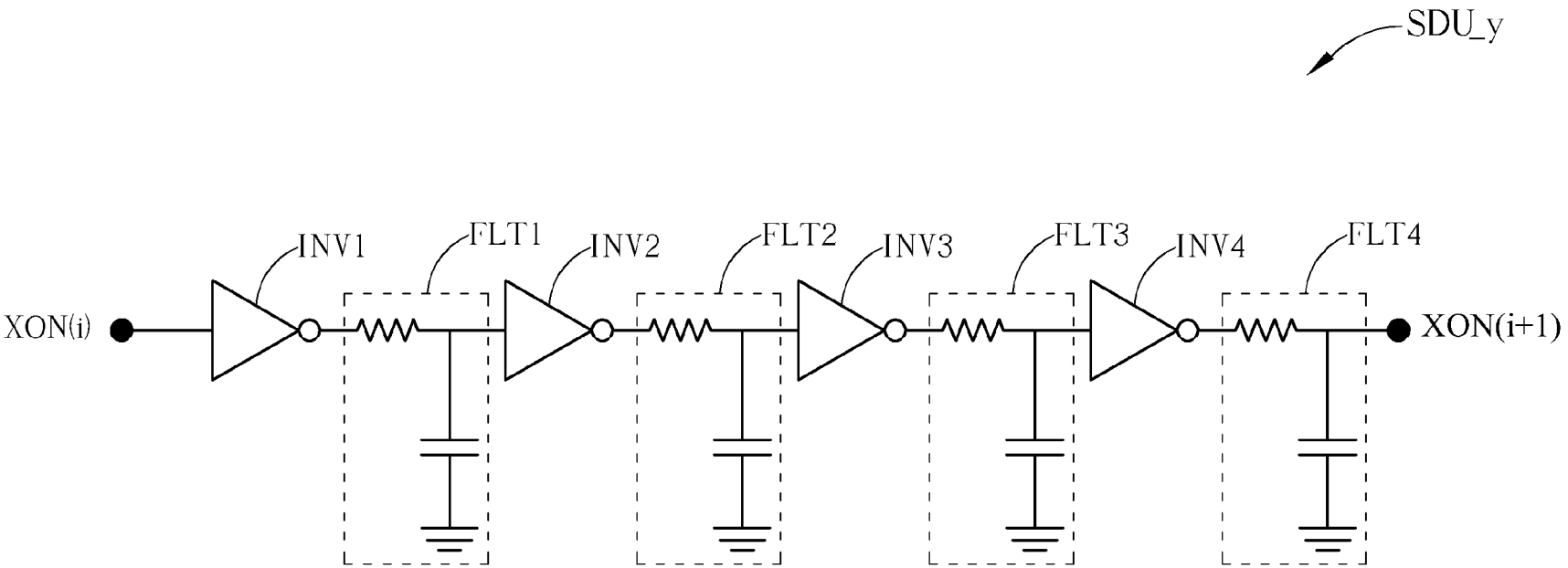
FIG. 3B is a schematic diagram of a shaping and delay unit according to another embodiment of the present invention.

Please refer to FIG. 3B, which is a schematic diagram of a shaping and delay unit SDU_y according to an embodiment of the present invention. The shaping and delay unit SDU_y is similar to the shaping and delay unit SDU_x shown in FIG. 3A, and includes inverters INV1-INV4 as well. Besides, the shaping and delay unit SDU_y further includes filtering circuits FLT_1-FLT_4. The filtering circuits FLT_1-FLT_4 include resistors and capacitors, and can delay input signals and filter some noise, to strengthen effects of delaying and shaping.

In FIG. 3B, the shaping and delay unit SDU_y can be seen as the shaping and delay unit SDU_x added with the filtering circuits FLT_1-FLT_4. Certainly, the number of added filtering circuits is not limited to four, and can be other numbers. For example, a shaping and delay units SDU_z shown in FIG. 3C only includes two filtering circuits FLT_a, FLT_b.

Figure 3C:
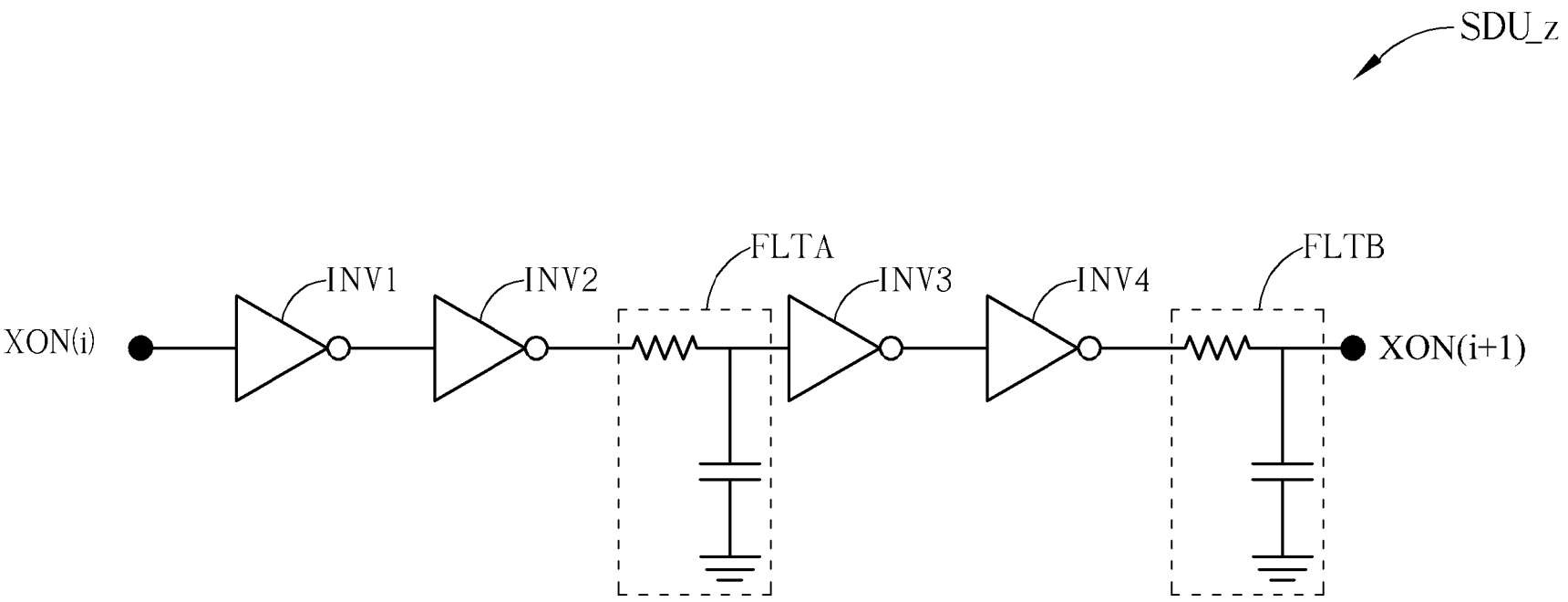
FIG. 3C is a schematic diagram of a shaping and delay unit according to another embodiment of the present invention.

Noticeably, the shaping and delay units SDU_x, SDU_y, SDU_z shown in FIG. 3A to FIG. 3C are utilized for illustrating possible realization of the shaping and delay units SDU_1-SDU_(n−1). Those skilled in the art can properly design the shaping and delay units SDU_1-SDU_(n−1) according to different delay time required by different display devices, for ensuring the time for the channels CH1-CHn to turn on the corresponding TFT 114 is separated, to facilitate dispersing currents, so as to avoid the voltage drop generated when currents passes conductive wires, for maintaining the following operations normally.

Figure 3D:
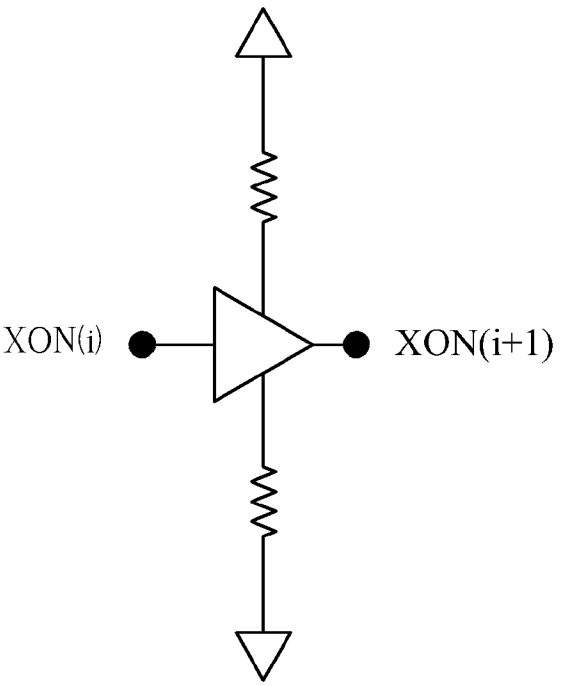
FIG. 3D to FIG. 3F are schematic diagrams of available buffer circuits for the gate driving circuit shown in FIG. 2A.
Figure 3E:
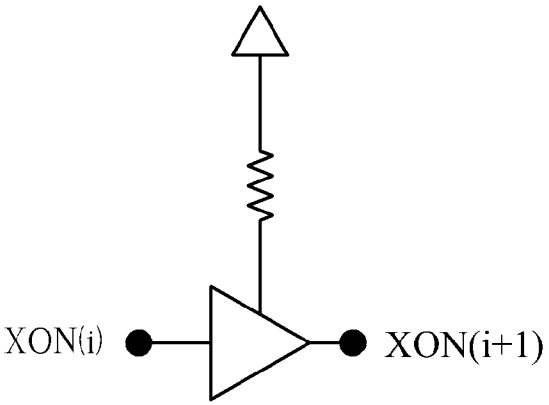
Figure 3F:
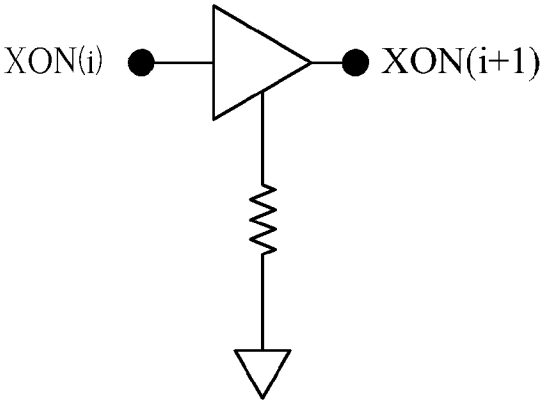

Furthermore, for increasing time constant for transmitting the shutdown indication signal XON, at least one buffer circuit can be set in the front-end of the transmission path of the shutdown indication signal XON (such as between the timing control circuit 102 and the logic circuit LGC_1 or between the logic circuit LGC_1 and the shaping and delay unit SDU_1, etc.) or any proper location, and is equivalent of a large resistor, while a (equivalent) large capacitor can be set at the back-end of the transmission path of the shutdown indication signal XON. Accordingly, the front-end and the back-end of the transmission path of the shutdown indication signal XON are added an equivalent large resistor and as equivalent large capacitor, respectively. As a whole, the time constant of the transmitting path of the shutdown indication signal XON can be increased, so as to separate the time for each channel to output the high voltage level voltage VGH when the shutdown indication signal XON is activated, for dispersing current supply. The applied buffer circuit is not limited to a specific type, e.g. (weak) pull-up and pull-down structure shown in FIG. 3D, (weak) pull-up structure shown in FIG. 3E or (weak) pull-down structure shown in FIG. 3F, etc., and those capable of properly enhancing resistance can be applied in the present invention.

Figure 4:
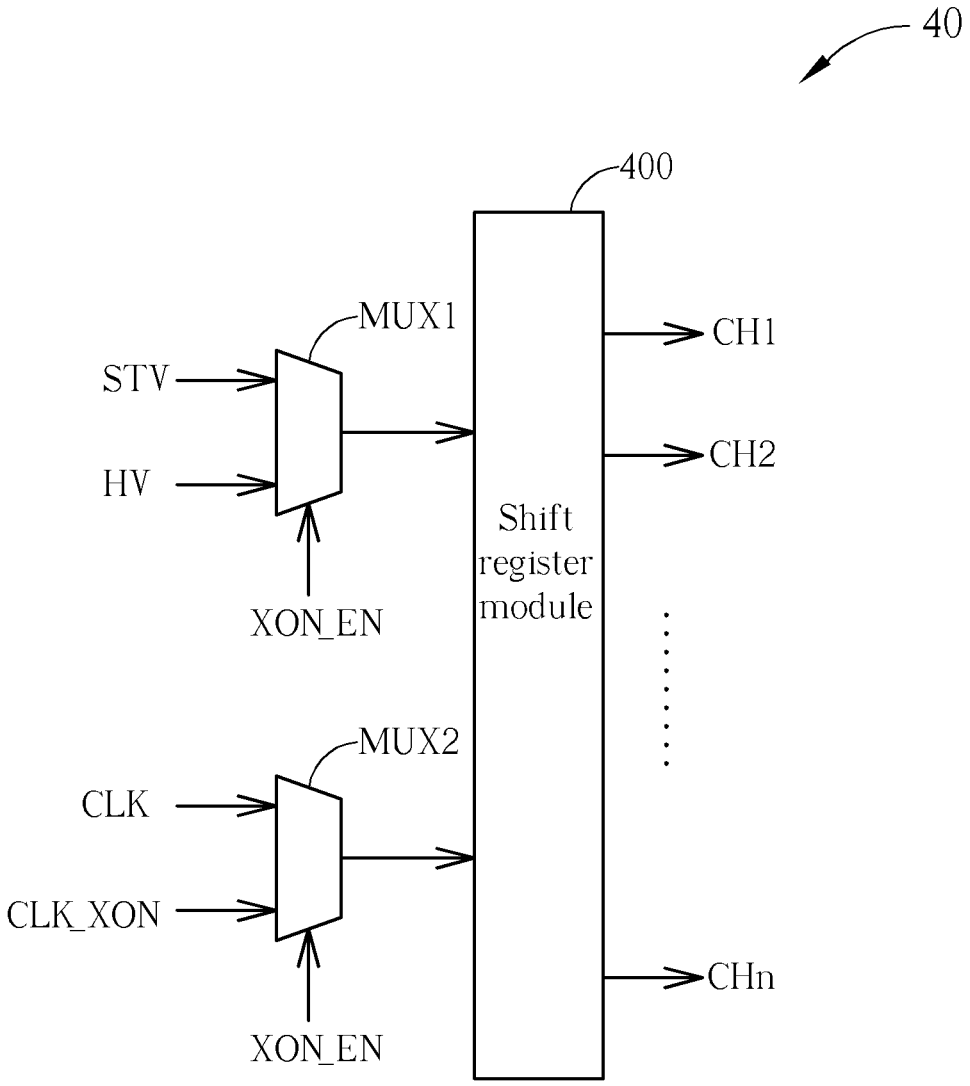
FIG. 4 is a schematic diagram of a gate driving circuit according to an embodiment of the present invention.

On the other hand, please refer to FIG. 4, which is a schematic diagram of a gate driving circuit 40 according to an embodiment of the present invention. The gate driving circuit 40 can be utilized for replacing the gate driving circuit 106 shown in FIG. 1 as well, to avoid the great current generated by charge releasing when the LCD device 10 is turn off. The gate driving circuit 40 includes a shift register module 400, a first multiplexer MUX1 and a second multiplexer MUX2. The first multiplexer MUX1 selects to output the start signal STV generated by the timing control circuit 102 or a high level signal HV to the shift register module 400 according to an enable signal XON_EN. The second multiplexer MUX2 selects to output the clock signal CLK generated by the timing control circuit 102 or a charge release clock signal CLK_XON to the shift register module 400 according to the enable signal XON_EN. The enable signal XON_EN is derived from the shutdown indication signal XON, and can be seen as a signal form of the shutdown indication signal XON, i.e. the shutdown indication signal XON or the inverted signal of the shutdown indication signal XON. Furthermore, the high level signal HV is corresponding to a logic "1" signal of the high voltage level voltage VGH. The clock signal CLK is utilized by the timing control circuit 102 to drive the clock of the LCD when displaying image, and can be called a display clock signal as well. The charge release clock signal CLK_XON is a required clock of the LCD device 10 when being turned off and releasing charges.

In a word, in a power-on mode, the first multiplexer MUX1 and the second multiplexer MUX2 output the start signal STV and the clock signal CLK to the shift register module 400 according to the enable signal XON_EN, respectively, such that the shift register module 400 can output scan signals to the channels CH1-CHn in display order. On the contrary, when the LCD device 10 is switched from the power-on mode to a power-off mode, the first multiplexer MUX1 and the second multiplexer MUX2 output the high level signal HV and the charge release clock signal CLK_XON to the shift register module 400 according to the enable signal XON_EN, respectively. Since the charge release clock signal CLK_XON is the predefined corresponding clock for releasing charges, the shift register module 400 sequentially outputs the high voltage level voltage VGH to the channels CH1-CHn according to predefined timing. In other words, designer can predefine a proper charge release clock signal CLK_XON according to system requirements, such that when the LCD device 10 is switched from the power-on mode to the power-off mode, the shift register module 400 sequentially outputs the high voltage level voltage VGH to the channels CH1-CHn with a specific delay period. Therefore, as long as the charge release clock signal CLK_XON is properly set, the time for the channels CH1-CHn to turn on the TFTs 114 can be effectively separated, to facilitate dispersing current and avoid the voltage drop generated when currents passes conductive wires, for maintaining following operations normally.

Therefore, by use of the gate driving circuit 40, designer can decide and separate the time for each channel to turn on the TFT via the charge release clock signal CLK_XON when the TFT is turned off and releases charge, to avoid the voltage drop generated when currents passes conductive wires.

In the prior art, since resistors/capacitors (RC) circuits have high variations and can not generate a uniform time constant, causing too less or too much delay. Thus, a voltage drop may be generated when currents passes conductive wires, which affects the operating timing of the gate driving circuit 106, and even results in abnormal display. On the contrary, in the above embodiment of the present invention, both the gate driving circuits 20, 40 shown in FIG. 2A and FIG. 4 can be utilized for replacing the gate driving circuit 106 shown in FIG. 1. Thus, when the TFT is turned off, the time for the channels CH1-CHn to turn on the TFTs 114 the channels CH1-CHn can be effectively separated, to facilitate dispersing current and avoid the voltage drop generated when currents passes conductive wires, for maintaining the following operations normally.

To sum up, when the TFT is turned off, the present invention can effectively separate the time for each channel to turn on a TFT, to facilitate dispersing current and avoid the voltage drop generated when currents passes conductive wires, for maintaining the following operations normally.

Those skilled in the art will readily observe that numerous modifications and alterations of the device and method may be made while retaining the teachings of the invention.

What is claimed is:

1. A gate driving circuit for a liquid crystal display (LCD) device, the LCD device comprising a plurality of channels, the gate driving circuit comprising:

a shift register module, for generating a plurality of scan signals corresponding to the plurality of channels according to a start signal and a clock signal;

a plurality of logic circuits, each corresponding to a channel of the plurality of channels, for outputting a driving signal to the channel according to a scan signal of the plurality of scan signals and a shutdown indication signal and outputting the shutdown indication signal; and a plurality of shaping and delay units, each of at least one of which is coupled between two of the logic circuits of the plurality of logic circuits corresponding to two neighboring ones of the channels, for shaping and delaying the shutdown indication signal outputted by one of the two logic circuits and providing the shaped and delayed shutdown indication signal to the other one of the two logic circuits, wherein when the shaping and delay unit performs the shaping and delaying, the shaping and delay unit does not refer to any signal related to a magnitude of the driving signal output by the one of the two logic circuits.

2. The gate driving circuit of claim 1, wherein each of the plurality of shaping and delay units comprises a plurality of inverters, cascaded in series.

3. The gate driving circuit of claim 2, wherein each of the plurality of shaping and delay units further comprises at least one filtering circuit, each filtering circuit coupled between two neighboring inverters.

4. The gate driving circuit of claim 3, wherein each of the at least one filtering circuit comprises resistors or capacitors.

* * * * *